US009435164B2

(12) United States Patent
Fenwick

(10) Patent No.: US 9,435,164 B2
(45) Date of Patent: Sep. 6, 2016

(54) CLOSED-LOOP HYDRAULIC RUNNING TOOL

(71) Applicant: Vetco Gray Inc., Houston, TX (US)

(72) Inventor: Rodney Mark Fenwick, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 17 days.

(21) Appl. No.: 13/714,598

(22) Filed: Dec. 14, 2012

(65) Prior Publication Data

US 2014/0166298 A1 Jun. 19, 2014

(51) Int. Cl.

| | |
|---|---|
| ***E21B 29/12*** | (2006.01) |
| ***E21B 41/04*** | (2006.01) |
| ***E21B 43/10*** | (2006.01) |
| ***E21B 23/08*** | (2006.01) |
| ***E21B 34/06*** | (2006.01) |
| ***E21B 43/12*** | (2006.01) |
| ***E21B 23/00*** | (2006.01) |
| ***E21B 33/04*** | (2006.01) |
| ***E21B 23/04*** | (2006.01) |

(52) U.S. Cl.

CPC ..... *E21B 23/00* (2013.01); *E21B 23/04* (2013.01); *E21B 33/04* (2013.01)

(58) Field of Classification Search

USPC ..... 166/348, 382

See application file for complete search history.

(56) References Cited

U.S. PATENT DOCUMENTS

| | | | | |
|---|---|---|---|---|
| 3,693,714 A | | 9/1972 | Baugh | |
| 3,871,447 A | | 3/1975 | Crowe | |
| 3,874,446 A | | 4/1975 | Crowe | |
| 4,712,621 A | | 12/1987 | Wightman et al. | |
| 4,736,799 A | * | 4/1988 | Ahlstone | 166/348 |
| 4,928,769 A | | 5/1990 | Milberger et al. | |
| 4,969,519 A | | 11/1990 | Kelly | |
| 5,088,556 A | * | 2/1992 | Short | E21B 33/038 166/339 |
| 5,188,180 A | | 2/1993 | Jennings | |
| 5,735,344 A | | 4/1998 | Duncan | |
| 5,791,418 A | * | 8/1998 | Milberger | E21B 33/043 166/334.4 |
| 6,343,654 B1 | * | 2/2002 | Brammer | 166/338 |

(Continued)

FOREIGN PATENT DOCUMENTS

EP 0405734 A2 1/1991

OTHER PUBLICATIONS

International Search Report and Written Opinion issued in connection with corresponding PCT Application No. PCT/US2013/074081 dated Oct. 24, 2014.

*Primary Examiner* — Matthew R Buck
*Assistant Examiner* — Douglas S Wood
(74) *Attorney, Agent, or Firm* — Bracewell LLP; James E. Bradley

(57) ABSTRACT

A method and apparatus for setting an inner wellhead member in a subsea wellhead housing includes connecting an inner wellhead member to a running tool and running the running tool and wellhead member through a tubular member to a wellhead housing. A plurality of pistons urge fluid through a closed-loop hydraulic system. That fluid actuates a locking mechanism to lock the inner wellhead member into the wellhead housing, and also actuates a release mechanism to release the running tool from the inner wellhead member. The pistons are moved from one position to another in response to fluid pressure from the running string to which the running tool is connected, fluid pressure from the tubular member in which the running tool is located, or in response to fluid in the closed-loop hydraulic system that is being moved in response to the other one of the pistons.

20 Claims, 6 Drawing Sheets

(56) References Cited

U.S. PATENT DOCUMENTS

| | | | | |
|---|---|---|---|---|
| 6,401,827 | B1 | 6/2002 | Ferguson et al. | |
| 7,028,777 | B2 * | 4/2006 | Wade | E21B 33/043 166/341 |
| 7,909,107 | B2 | 3/2011 | Gette | |
| 2005/0133216 | A1 | 6/2005 | Bartlett | |
| 2011/0247798 | A1 | 10/2011 | June et al. | |
| 2011/0247799 | A1 | 10/2011 | June et al. | |

* cited by examiner

CLOSED-LOOP HYDRAULIC RUNNING TOOL

BACKGROUND OF THE INVENTION

1. Field of the Invention

The present invention relates in general to mineral recovery wells, and in particular to a running tool for running a wellbore tool through a tubular member.

2. Brief Description of Related Art

Running tools are used to run wellbore members, such as tubing hangers or internal tree caps, through a tubular member to the desired landing location. For example, a running tool can be used to run a tubing hanger from a drilling platform, through a riser, to a subsea wellhead housing. When the wellbore member is landed, the running tool must be actuated to release latch the wellbore member in place, and then the running tool must be disconnected from the now-set wellbore member. Control mechanisms to actuate the running tool can be problematic or time consuming. For example, hydraulic lines can be deployed through the riser to the running tool, or sometimes by way of a dart connected to the running tool, but the hydraulic lines require more time and expense for running or retrieval operations. Wirelines similarly can add time and expense to the operation. Some running tools are actuated by causing the running tool to rotate, as by rotating the running string on which the running tool is run. Such rotation can be difficult in deepwater operations because it can be difficult to transmit a precise amount of rotation through a long riser assembly. There are also problems associated with using wellbore fluid pressure to actuate running tools because the wellbore fluid can clog or foul the running tool. It is desirable to operate a running tool using existing wellbore and drilling fluids without the risk of such fluids impairing the operation of the running tool.

SUMMARY OF THE INVENTION

A running tool and method for running a tubing hanger through a tubular member and landing the tubing hanger in a wellbore member are each disclosed. The running tool is deployed on running string and used to run a tubing hanger from a drilling platform through a riser to a subsea wellhead housing. The tubing hanger can be landed in the subsea wellhead housing and locked in place and the running tool withdrawn, without the use of control lines, such as hydraulic lines or other umbilical lines. The running tool components can be actuated by providing external pressure through a blow-out preventer ("BOP") stack and pressure through the running string. For illustration purposes, the running tool is shown used with a tubing hanger, but can also be used with an internal tree cap.

The running tool is initially set up by connecting a line and pressurising an outer cylinder through an outer housing connection point to move an outer piston down. Only low pressure, such as 500-1000 psi, is needed to move the piston in this manner. When the fluid pressure moves the outer piston down, the outer piston creates pressure in a closed-loop hydraulic system. An actuation sleeve and latch each have a piston in communication with the closed-loop hydraulic system, and are thus actuated by the movement of the outer piston. The actuation sleeve is stroked to its fully up 'unlocked' position and the latch is stroked to its fully up 'unlatched' position. The action/fluid pressure of the actuation sleeve and latch moving upwards forces fluid through the closed-loop hydraulic system and, in response, strokes the inner piston upwards.

In embodiments, the full stroke of the outer piston to function the actuation sleeve and latch pistons through their full strokes is about 8.28" and the necessary stroke for the inner piston is about 9.31". In embodiments, the available stroke for the outer piston is about 9.25" while the available stroke for the inner piston is about 10.25". Other stroke lengths and maximum travel distances can be used depending on the design and requirements of the running tool.

With the actuation sleeve and latch in the correct positions, a setting tool can be installed into a bore of the running tool to seal off a sub at the lower end of the running tool. The setting tool can be fitted with a lift eye for handling purposes. A standard handling sub can now be attached to a running tool drill stem connection, with a line attached. The handling sub can also keep the setting tool in position.

The running tool can now be picked up and landed out on a tubing hanger. Dimensional verification of landing and positioning of the running tool relative to the tubing hanger can be carried out. An aperture in each of the running tool re-entry sleeve and tubing hanger actuation sleeve provide for a visible check of a load ring land out on a tubing hanger shoulder. A low capacity shear pin or detent mechanism is used to maintain the tubing hanger actuation sleeve in the up position while running.

A high capacity shear screw is then fitted to the running tool actuation sleeve to prevent it from moving downward. Low pressure, for example about 500-1000 psi, is applied via the handling sub to stroke inner piston down and thereby keep the latch down to maintain the connection between the running tool and the tubing hanger.

A low capacity shear screw is now fitted to the actuation sleeve to engage the groove in the latch piston. Although the latch is pressure balanced whilst running, this low capacity shear screw stops movement and unlocking of the tool from the tubing hanger. The handling sub and setting tool are removed, and drill pipe or running string is connected to the running tool. The running tool, and tubing hanger, are then run down through the riser and landed out in the wellhead.

If there is insufficient weight to fully set the tubing hanger, the blowout preventer ("BOP") rams can be closed around the running string and pressure applied to pressure set the equipment. As the area of the drill pipe or running string is smaller than the seal between the running tool and the tubing hanger, the running tool is forced downwards and, thus, urges the tubing hanger downwards. In embodiments, the pressure required to set the tubing hanger is less than or equal to about 250 psi, and this pressure is below the threshold pressure required to shear the high and low capacity shear screws and, thus, actuate the running tool.

Drill pipe or running string pressure can be applied to keep the latch piston in the down position. For this purpose, the drill pipe pressure only needs to be slightly higher than the BOP choke and kill line pressure.

If BOP stack pressure was used during run in, it is vented after the tubing hanger is fully landed. The operator then applies pressure down the drill pipe or running string. The pressure will shear out the running tool actuation sleeve shear screw, allowing the pressure to urge the actuation sleeve downward. The actuation sleeve then urges the tubing hanger actuation sleeve downward, overcoming a low capacity shear screw or detent mechanism that holds the tubing hanger actuation sleeve in place. The tubing hanger actuation sleeve urges latch dogs outward to latch the tubing hanger in place. Once latched, the operator can pull upward on the drill pipe (standard overpull) to confirm correct locking of the tubing hanger. After releasing the overpull force, the running tool is now ready to be recovered.

The drill pipe pressure is vented down and pressure is applied via the BOP stack choke and kill connection to the outside of the tool. This will stroke the outer piston fully down, thereby moving the tool actuation sleeve to its fully up position, at the same time stroking the latch piston to its fully 'unlatched' up position. The running tool can now be recovered to surface.

An embodiment of a method for setting an inner wellhead member in a subsea wellhead includes the steps of releasably connecting an inner wellhead member to a running tool; running the running tool and the inner wellhead member, on a running string, through a tubular member to the wellhead housing; latching the wellhead member to the wellhead housing by increasing fluid pressure in one of the tubular member and the running string; disconnecting the running tool from the inner wellhead member by increasing fluid pressure in one of the tubular member and the running string; and withdrawing the running tool on the running string.

In embodiments, the running tool can include a first piston and a second piston, each piston moving in response to the fluid pressure increase in one of the tubular member and the running string, wherein movement of one of the pistons causes the wellhead member to latch into the wellhead housing and movement of the other one of the pistons causes the running tool to disconnect from the inner wellhead member. In embodiments, each of the pistons are in communication with a closed-loop hydraulic system containing a closed-loop hydraulic fluid, and the closed-loop hydraulic fluid causes the wellhead member to latch into the wellhead housing and the running tool to disconnect from the inner wellhead member. In embodiments, each of the first piston and the second piston are in communication with a single reservoir of the closed-loop hydraulic system so that movement of one of the pistons urges the other one of the pistons to move.

In embodiments, the pistons prevent the closed-loop hydraulic fluid from contacting each of the fluids in the tubular member and in the running string. In embodiments, fluid pressure in the tubular member urges one of the pistons from a first position to a second position, the movement of the one of the pistons from the first position to the second position causing the closed-loop hydraulic fluid to move, the movement of the closed-loop hydraulic fluid urging an actuation sleeve from an unlatched position to a latched position to latch the wellhead member. In embodiments, fluid pressure in the tubular member is increased by closing a blowout preventer and applying a choke and kill pressure.

An embodiment of a running tool for setting an inner wellhead member in a subsea wellhead housing includes a setting piston and a release piston, each piston comprising a first end and a second end; an actuation sleeve, the actuation sleeve moving from an unlocked position to a locked position in response to movement of one of the pistons, the actuation sleeve urging a locking member of the inner wellhead member into engagement with the subsea wellhead housing when moving from the unlocked position to the locked position; a latch sleeve, the latch sleeve moving from an unlatched position to a latched position in response to movement of one of the pistons, the latched position keeping the inner wellhead member connected to the running tool; and the pistons and sleeves each being in communication with a closed-loop hydraulic system containing a hydraulic fluid.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
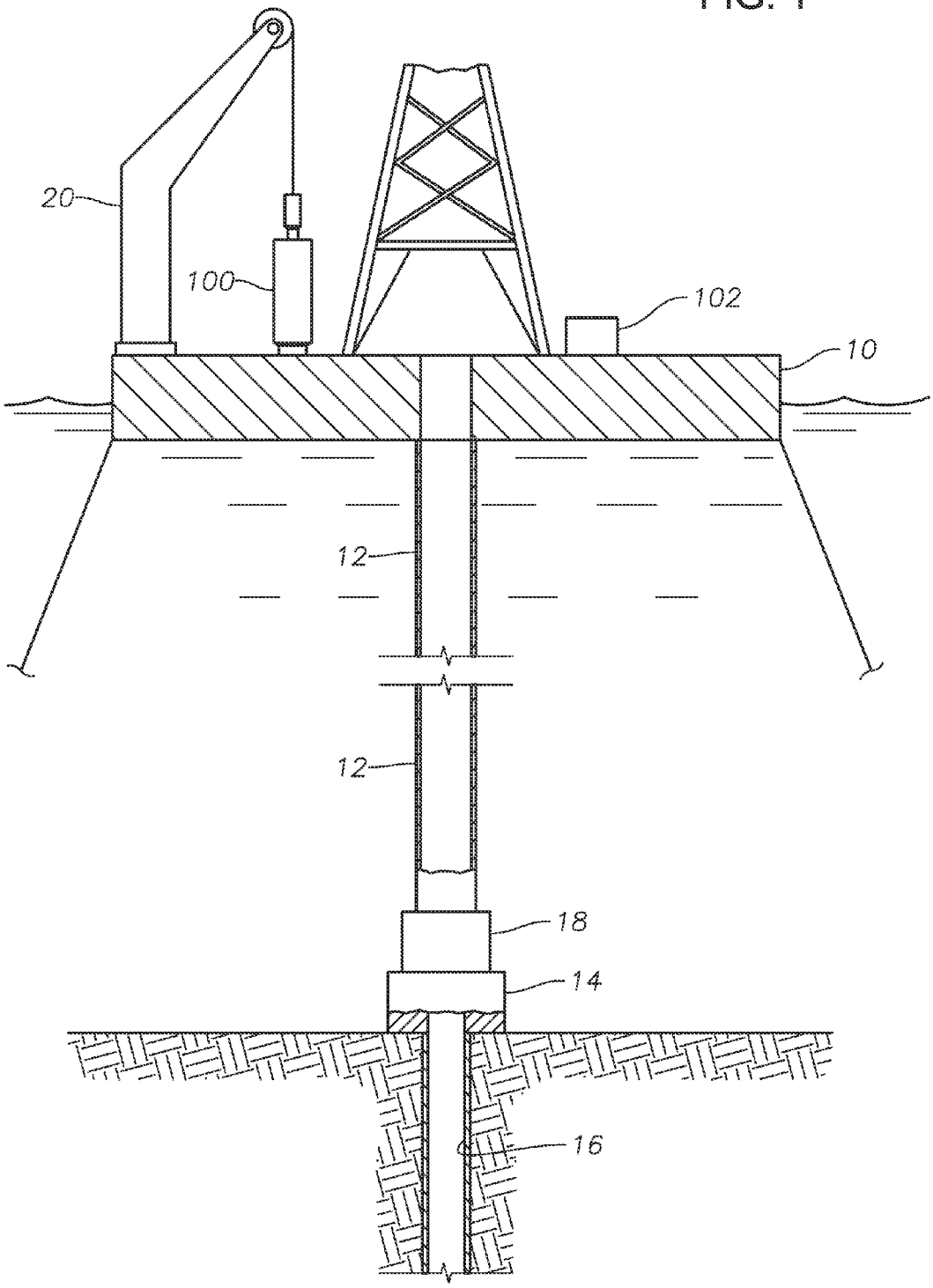
FIG. 1 is a partially sectional environmental view of a subsea riser extending between a drilling platform and a subsea wellhead.

Referring to FIG. 1, a drilling platform 10 is shown. Drilling platform 10 is shown as a deepwater drilling platform, but can be any type of sea or land drilling platform or rig. Riser 12 extends from drilling platform 10 through the sea to subsea wellhead housing 14. Wellhead housing 14 is connected to wellbore 16. Blowout preventer ("BOP") 18 is used to selectively prevent fluid from passing through riser 12. Hoist 20 is a crane or lift device on platform 10. As will be described in more detail, running tool 100 and tubing hanger 102 are shown sitting on platform 10.

Figure 2:
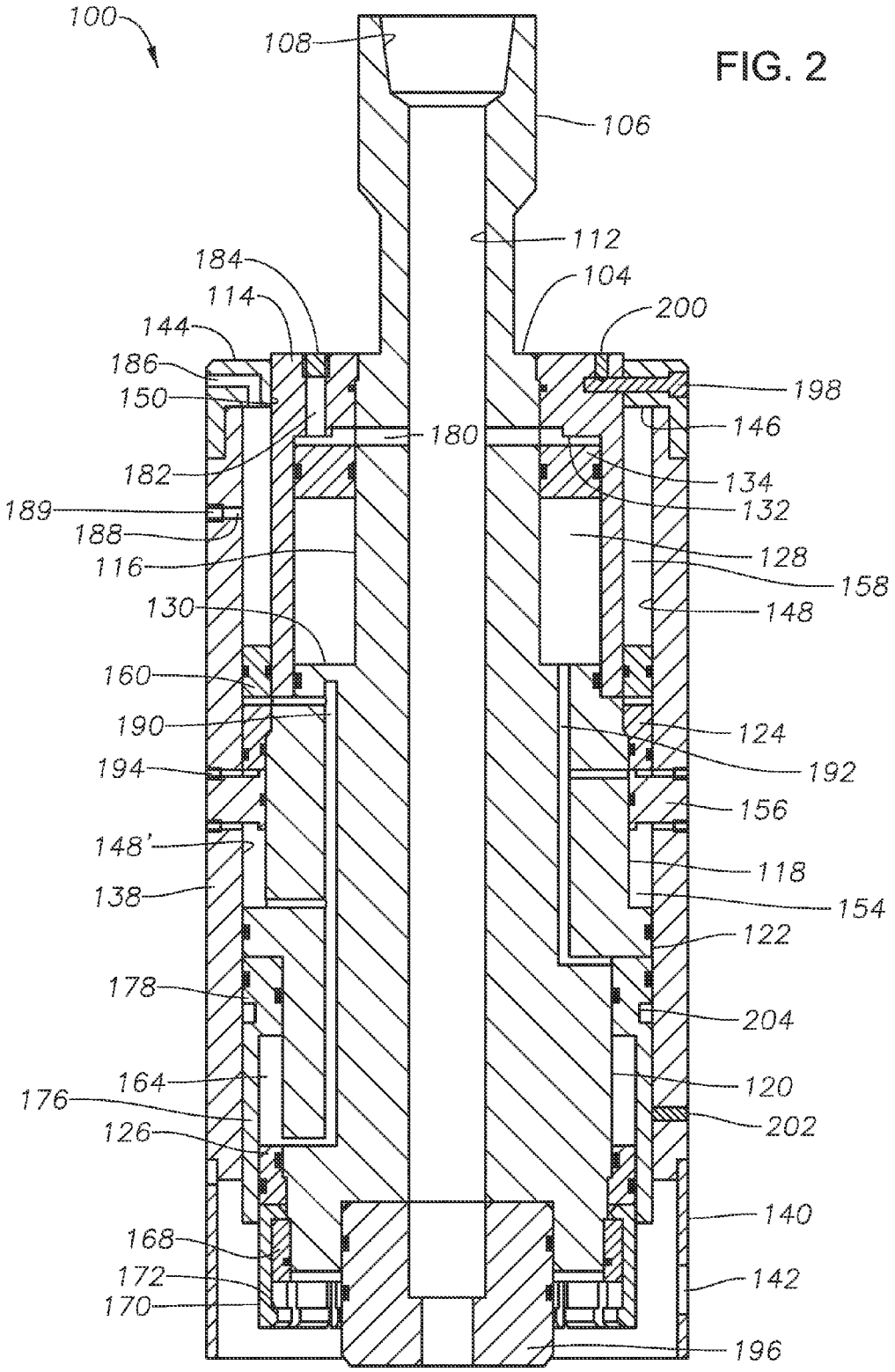
FIG. 2 is a sectional side view of an embodiment of an umbilical-less running tool.
Figure 5:
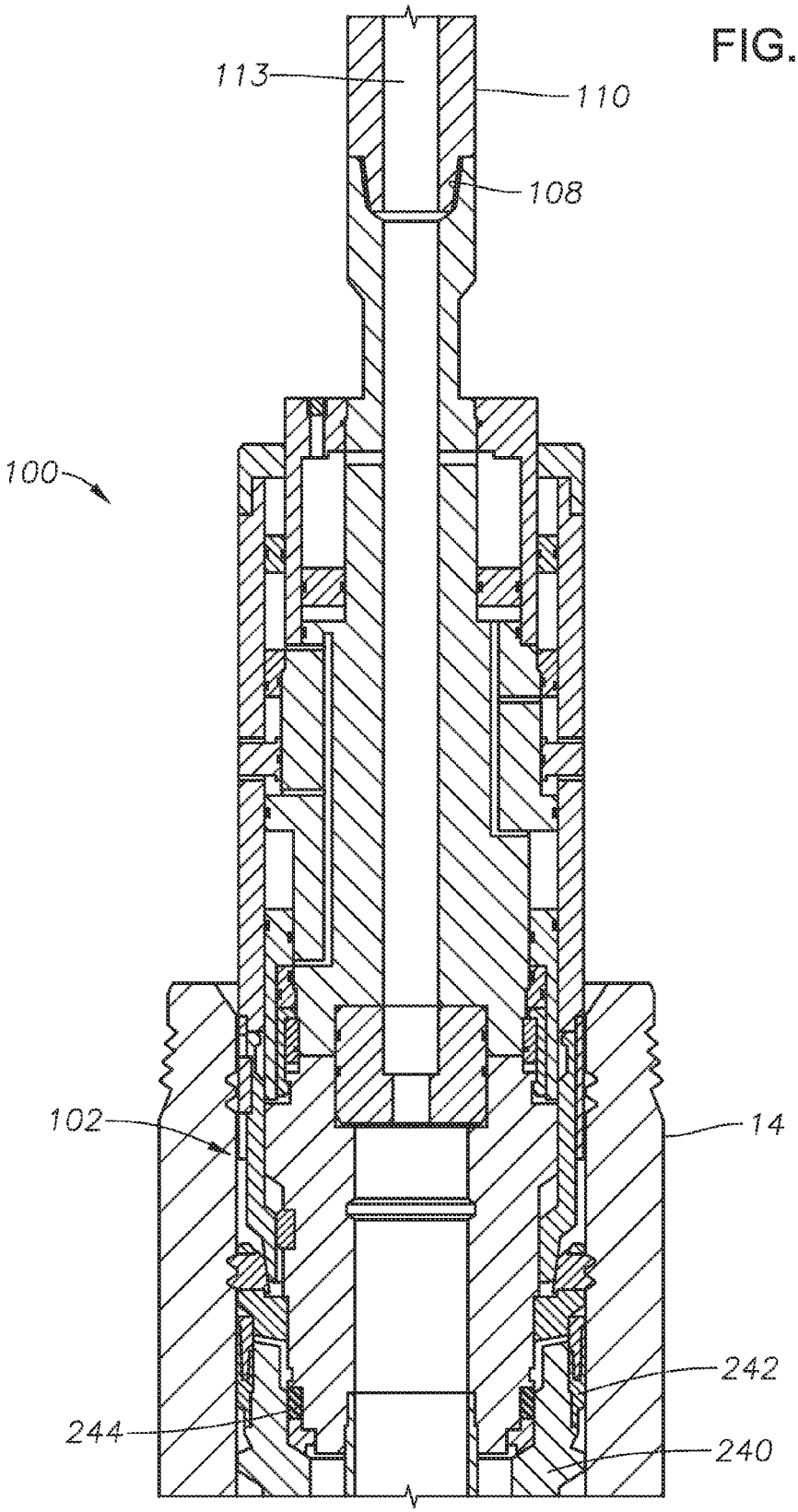
FIG. 5 is a sectional side view of the umbilical-less running tool of FIG. 2 and tubing hanger of FIG. 3, set in the wellhead housing of FIG. 1.

Referring to FIG. 2, running tool 100 is a running tool used to position a wellbore member, such as tubing hanger 102 (FIG. 3), in a wellbore. Other wellbore members, such as internal tree caps ("ITC"), can also be positioned with embodiments of running tool 100. Running tool 100 includes a body 104, which is shown as a generally cylindrical body and can include neck 106 extending upward from body 104. Connector 108 is a connector at an end of body 104, on an inner diameter of neck 106, that is used to connect running tool 100 to a tubular member such as running string 110 (FIG. 5). Central bore 112 is an axial passage through body 104 that communicates fluid from string bore 113 (FIG. 5), of running string 110, through body 104. Outer body 114 is a part of body 104 that is cylindrical member forming a portion of the exterior of body 104, but other configurations are possible. Body 104 has distinct outer diameter ("OD") surfaces that will define an inner diameter ("ID") of various annular spaces that are formed when another member is concentrically positioned on the outer diameter of body 104. Inner cylinder ID 116 is an outer diameter surface of body 104 below neck 106. Actuation sleeve cylinder ID 118 is an OD surface of body 104 positioned below inner cylinder ID 116 and has a greater outer diameter than inner cylinder ID 116. Latch cylinder ID 120 is an OD surface of body 104 located below actuation sleeve cylinder ID 118. The OD of latch cylinder ID 120 is smaller than the OD of actuation sleeve cylinder ID 118, but greater than the OD of inner cylinder ID 116. Guide surface 122 protrudes outward from body 104 between actuation sleeve cylinder ID 118 and latch cylinder ID 120, and has the greatest outer diameter of any part of body 104. Upper seal ring 124 is an annular ring positioned on an outer diameter of body 104. Upper seal ring 124 is positioned below both inner cylinder ID 116 and outer body 114, and at the upper end of actuation sleeve cylinder ID 118. Lower seal ring 126 is an annular ring positioned on an outer diameter near the lower end of body 104. Lower seal ring 126 is positioned to protrude from latch cylinder ID 120.

Inner cylinder 128 is an annular space between an outer diameter of body 104 and an inner diameter of outer body 114. The sidewalls of inner cylinder 128 are concentric cylinders having a generally smooth surface. Lower shoulder 130 on body 104 defines an end of inner cylinder 128, and upper shoulder 132, which is a downward facing shoulder of outer body 114, defines the other end of inner cylinder 128. Inner piston 134 is positioned within inner cylinder 128 and can slidingly move within inner cylinder 128 in response to pressure differentials above and below inner piston 134.

Actuation sleeve 138 is shown as a cylindrical sleeve positioned concentrically on the outer diameter of body 104. An inner diameter surface of actuation sleeve 138 slidingly and sealingly engages guide surface 122. Orientation sleeve 140 is an annular sleeve extending from a lower end of actuation sleeve 138. Orientation sleeve 140 can be a separate member connected to actuation sleeve 138, as shown in FIG. 2, or orientation sleeve 140 can be integrally formed with actuation sleeve 138. Landing view hole 142 is an aperture through a sidewall of orientation sleeve 140. Actuation sleeve cap 144 can define the upper end of actuation sleeve 138. Actuation sleeve cap 144 can be connected to actuation sleeve 138 by, for example, threads, bolts, or other techniques. As shown in FIG. 2, cap 144 has a downward facing shoulder 146 that extends inward from inner diameter surface 148 of actuation sleeve 138. An inner diameter surface 150 of cap 144 slidingly engages an outer diameter surface of outer body 114.

Actuation sleeve cylinder 154 is an annulus defined by actuation sleeve cylinder ID 118 and an inner diameter 148' of actuation sleeve 138. The upper end of actuation sleeve cylinder 154 is defined by a lower end of upper seal ring 124, and the lower end of actuation sleeve cylinder 154 is defined by an upward facing shoulder of guide surface 122. Sleeve piston 156 protrudes inward from the inner diameter 148' of actuation sleeve 138, such that sleeve piston 156 sealingly and slidingly engages actuation sleeve cylinder ID 118, between a downward facing edge of upper seal ring 124 and an upward facing shoulder of guide surface 122.

Outer cylinder 158 is an annulus defined by an outer diameter of outer body 114 and inner diameter 148 of actuation sleeve 138. Downward facing shoulder 146 of cap 144 defines an upper end of outer cylinder 158. An upward facing surface of upper seal ring 124 defines the lower end of outer cylinder 158. Outer piston 160 is positioned within outer cylinder 158 and can slidingly move within outer cylinder 158 in response to pressure differentials above and below outer piston 160.

Latch cylinder 164 is an annulus defined by an inner diameter of actuation sleeve 138 and latch cylinder ID 120. The upper end of latch cylinder 164 is defined by a downward facing shoulder of guide surface 122, and the lower end is defined by an upward facing shoulder of lower seal ring 126.

Figure 3:
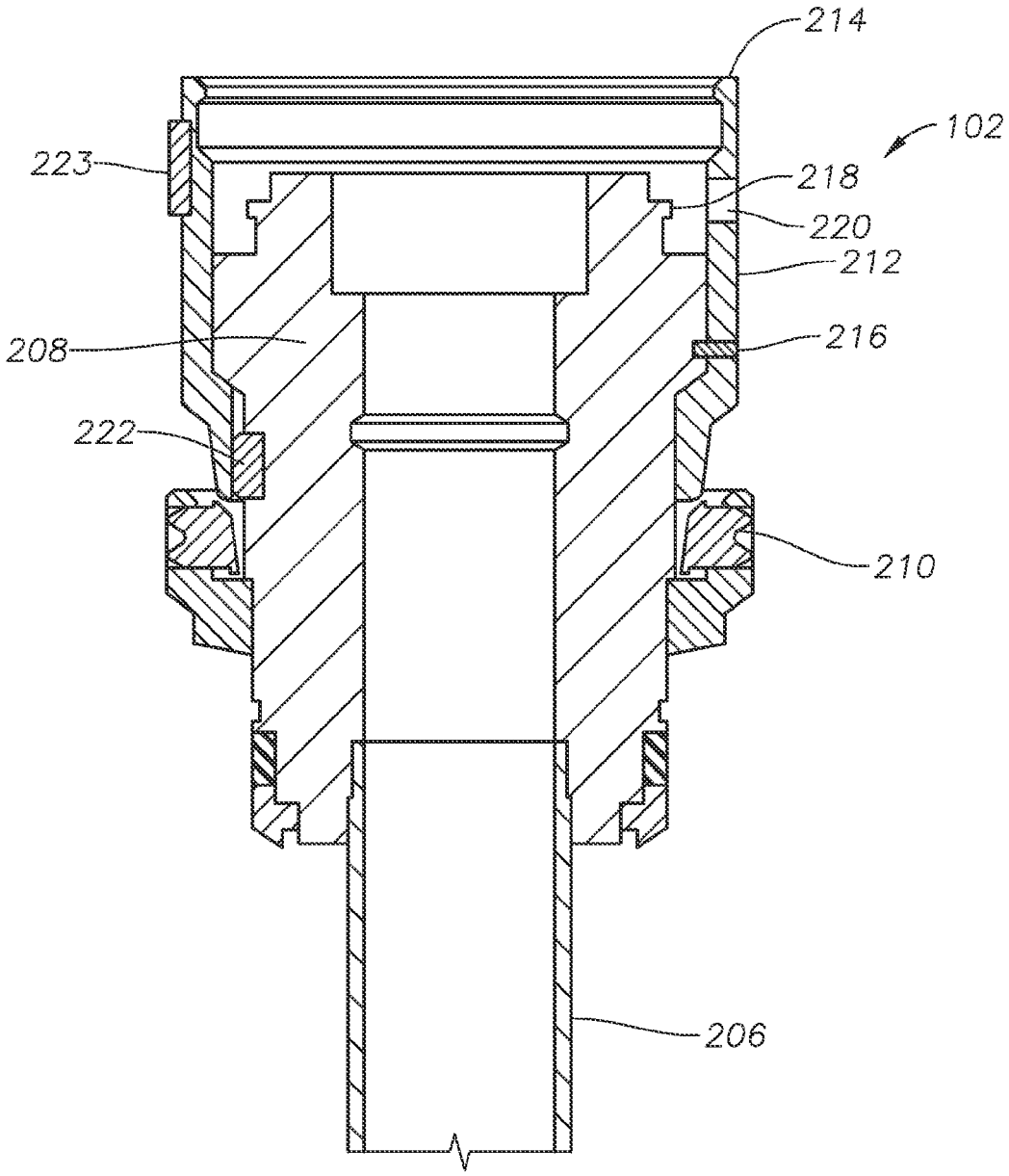
FIG. 3 is a sectional side view of an embodiment of a tubing hanger for use with the running tool of FIG. 2.

Load ring 168 is an annular ring at the lower end of body 104. Load ring 168 is connected to body 104 by bolts, threads, or other techniques. Latching elements 170 are a plurality of connectors, such as collet fingers, spaced apart around the lower end of body 104 and in contact with load ring 168. The lower end of latching elements 170 can have an upward facing shoulder 172 for engaging tubing hanger 102 (FIG. 3). The lower end of latching elements 170 can move radially outward from a latch position to a release position. Latch 176 is an annular ring that can move downward to secure latching elements 170 in the latch position, thus preventing latching elements 170 from moving radially outward. Latch 176 includes latch piston 178, shown in FIG. 2 at an upper end of latch 176, that slidingly and sealingly engages latch cylinder 164. Latch piston 178, and thus latch 176, moves up or down in response to a pressure differential above and below latch piston 176.

Running tool 100 includes a plurality of fluid passages that, along with the pistons and cylinders, create a closed-loop hydraulic system. As will be described in more detail, fluids from the running string 110, via central bore 112, and fluid external to running tool 100 can actuate running tool 100 without entering the closed-loop hydraulic system.

Bore fluid passage 180 is a passage that communicates fluid from central bore 112 to an upper end of inner cylinder 128, above inner piston 134. Bore fluid passage 180 is a large port and, thus, is debris tolerant. Inner cylinder port 182 is a passage through an upper end of outer body 114 that can communicate fluid external to running tool 100 into inner cylinder 128, above inner piston 134 for flushing and cleaning purposes. Plug 184 is used to plug inner cylinder port 182 during tool running operations.

Sleeve fluid passage 186 is a fluid passage from the exterior of running tool 100 through actuation sleeve 138 or actuation sleeve cap 144 into the upper portion of outer cylinder 158, above outer piston 160. Sleeve fluid passage 186 is a large port that is debris tolerant. Outer cylinder port 188 is a passage through the sidewall of actuation sleeve 138 or through actuation sleeve cap 144 that can communicate fluid external to running tool 100 into outer cylinder 158, above outer piston 160 for flushing and cleaning purposes. Plug 189 is used to plug outer cylinder port 188 during tool running operations.

Outer passage 190 is a fluid passage that is part of the closed-loop hydraulic system. Outer passage 190 communicates fluid from outer cylinder 158, below outer piston 160, to actuation sleeve cylinder 154, below sleeve piston 156. Outer passage 190 also communicates fluid to latch cylinder 164, below latch piston 178. Therefore, when outer piston 160 moves downward, it urges fluid into outer passage 190, thus urging fluid into the lower portion of actuation sleeve cylinder 154 and into the lower portion of latch cylinder 164, thus urging actuation sleeve 138 and latch 176 upward.

Inner passage 192 is a fluid passage that is part of the closed-loop hydraulic system. Inner passage 192 communicates fluid from inner cylinder 128, below inner piston 134, to actuation sleeve cylinder 154, above sleeve piston 156. Inner passage 192 also communicates fluid to latch cylinder 164, above latch piston 178. Therefore, when inner piston 134 moves downward, it urges fluid into inner passage 192, thus urging fluid into the upper portion of actuation sleeve cylinder 154 and into the upper portion of latch cylinder 164, thus urging actuation sleeve 138 and latch 176 downward.

Various fluid cylinders can have plugs 194, as shown in FIG. 2. Plugs 194 are used, for example, to introduce or relieve fluid from the closed-loop hydraulic system to achieve the appropriate fluid level in various regions such as in actuation sleeve cylinder 154, above and below sleeve piston 156, and latch cylinder 164, above and below latch piston 178. Furthermore, plugs 194 can be removed so that the entire closed-loop hydraulic system can be flushed after use without disassembling running tool 100. Seal sub 196 is a sealing assembly that can be connected to a counter bore at the lower end of running tool body 104. Seal sub 196 can sealingly engage running tool body 104, thus forming a continuous flowpath therethrough.

Shear pins can be used to affix two adjacent components to each other until a predetermined amount of shear force causes the shear pin to separate, thus allowing one of the adjacent components to move relative to the other one. As one of skill in the art will appreciate, shear pins can be other types of shearing devices such as shear bolts or shear screws. Furthermore, other devices can be used to prevent adjacent components from moving relative to each other until a predetermined amount of shear force causes the device to release the components. Such other devices can include, for example, spring-loaded detents and biased snap rings. The embodiment shown herein refers to shear pins with the understanding that other types of selectively released devices can be used.

Shear pin 198 is a shear pin that is inserted through actuation sleeve cap 144 into a bore of outer body 114. Shear pin 198 prevents actuation sleeve 138 from moving, relative to body 104, until a predetermined amount of shear force causes shear pin 198 to shear. Dog point set screw 200 is inserted through the top of sleeve cap 144 to engage the sheared portion of shear pin 198, thus preventing the sheared portion from falling out after being sheared and potentially causing damage or inoperability of running tool 100. Shear pin 202 can be inserted through the sidewall of actuation sleeve 138 into groove 204 of latch 176, thus preventing latch 176 from moving relative to actuation sleeve 138 until a predetermined amount of shear forces urges them apart. Groove 204 can be an annular groove around the circumference of latch 176, so that rotation is not necessary to align shear pin 202 with groove 204. Alternatively, a bore into the sidewall of latch 176 can be used, but then rotational alignment may be necessary.

Referring now to FIG. 3, tubing hanger 102 is shown apart from running tool 100. Tubing hanger 102 can be landed in, for example, a wellhead housing 14 (FIG. 1) and used to suspend tubing 206 in the wellbore. Tubing hanger 102 includes tubing hanger body 208. Tubing hanger locking element 210 protrudes from the sides of tubing hanger body 208 and is used to lock tubing hanger 102 into the wellhead housing 14 (FIG. 1). Tubing hanger actuation sleeve 212 is a sleeve connected to tubing hanger body 208 that can be moved downward to urge tubing hanger locking element 210 outward. The upper surface 214 of tubing hanger actuation sleeve 212 can be above tubing hanger body 208. Upper surface 214 is a flat surface that can contact the downward facing surface at the lower end of actuation sleeve 138.

Shear pin 216 can secure tubing hanger actuation sleeve 212 to tubing hanger body 208 so that the two components cannot move relative to each other until a predetermined amount of shear force causes shear pin 216 to shear. Shear pin 216 can be a low capacity shear pin such that the amount of forcer required to cause it to shear is less than the amount of force required to cause shear pin 198 to shear.

Engagement ring 218 is an annular ring protruding from an outer diameter surface of tubing hanger body 208 and can be an integral profile of body 208, as shown in FIG. 3. Engagement ring 218 is sized such that latching elements 170 can engage engagement ring 218 to connect tubing hanger 102 to running tool 100. Orifice 220 is a view port through a sidewall of tubing hanger actuation sleeve 212. Orifice 220 enables a user to observe the correct land out of the tool load ring 168 onto the mating face, as well as engagement of latching elements 170 on engagement ring 218.

Orientation key 222 is a key connected to tubing hanger body 208 that engages a slot in tubing hanger actuation sleeve 212. Orientation key 222 prevents tubing hanger actuation sleeve 212 from rotating, relative to tubing hanger body 208, when tubing hanger actuation sleeve is moving axially. Orientation key 223 is a key mounted on the OD of tubing hanger actuation sleeve 212. Orientation key 223 prevents the tool orientation sleeve 140 from rotating, relative to tubing hanger actuation sleeve 212.

Figure 4:
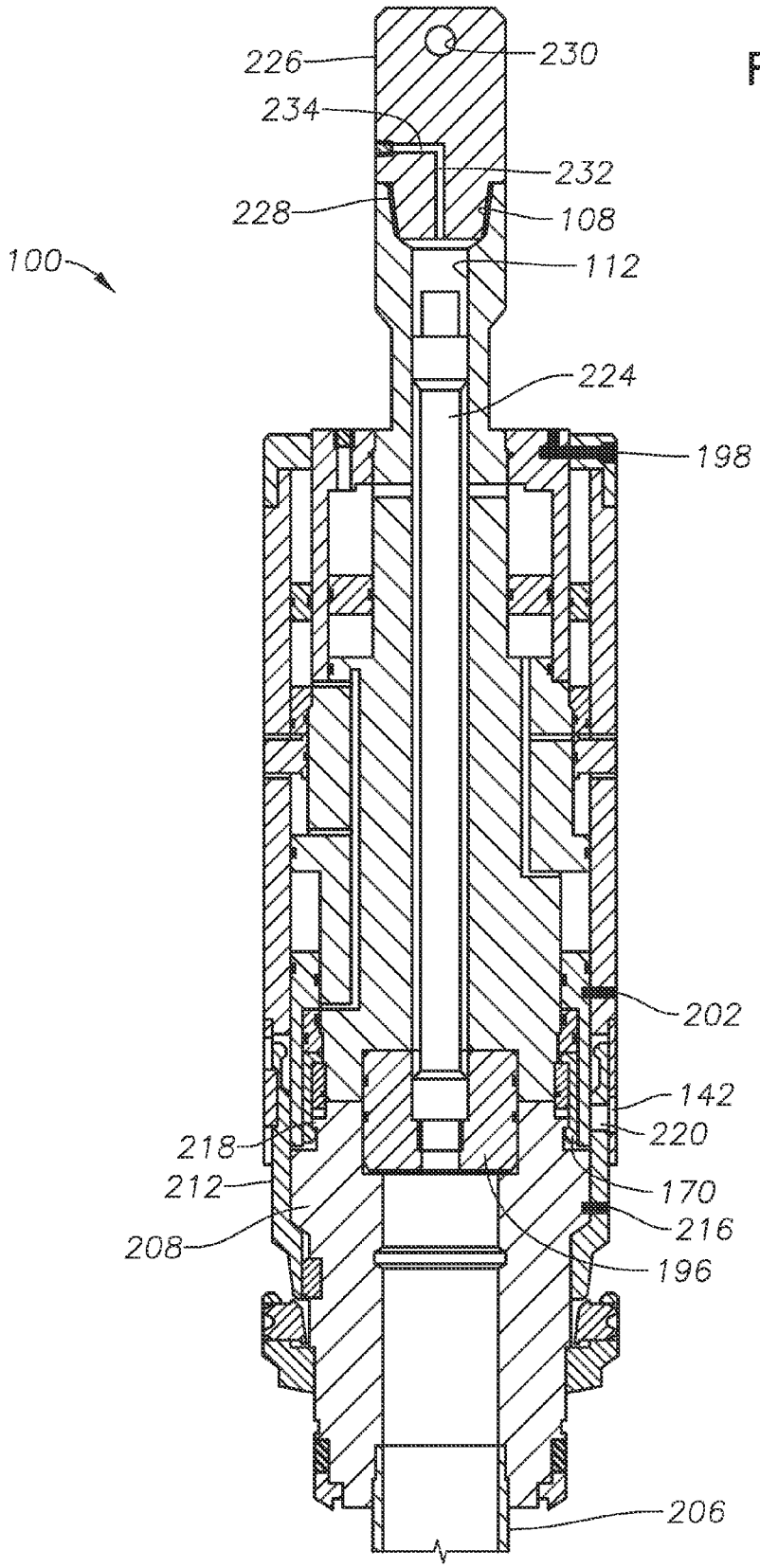
FIG. 4 is a sectional side view of the umbilical-less running tool of FIG. 2 connected to the tubing hanger of FIG. 3.

Referring now to FIG. 4, plug tool 224 is a tool that is inserted into central bore 112 of running tool 100 and connected to seal sub 196. Plug tool 224 is used to seal the central bore 112 at the lower end of the running tool 100. Fluid can flow into an annulus between the shaft of plug tool 224 and central bore 112. Handling sub 226 is a tool used to lift and position running tool 100. Handling sub 226 includes a connector, such as threads 228, at a lower end. Threads 228 threadingly engage connector 108 of running tool 100. The upper end of handling sub 226 includes lift point 230 which is, for example, a lift eye that can be connected to a hoist 20. Handling sub 226 has a central passage 232 that communicates fluid from fluid connection point 234 through a bore at the lower end of handling sub. When handling sub 226 is connected to running tool 100, a hose (not shown) can be connected to fluid connection point 234, and fluid from the hose (not shown) can flow through connection point 234, through handling sub 226, and into the annulus between plug tool 224 and central bore 112 of running tool 100.

Referring back FIG. 2, running tool 100 is prepared on, for example, the deck of drilling platform 10 (FIG. 1) before being lowered into a tubular member such as riser 12 (FIG. 1). For preparation, a hose (not shown) is connected to sleeve fluid passage 186. A single clean water line is sufficient for setting and locking running tool 100 onto tubing hanger 102. Fluid pressure applied through the hose urges outer piston 160 down. The downward movement of outer piston 160 creates closed-loop hydraulic pressure in outer passage 190, thus urging actuation sleeve 138 to its fully up, or unlocked, position. Pressure in outer passage 190 also urges latch 176 to its fully up, or unlatched, position. The pressure required at sleeve fluid passage 186, to move actuation sleeve 138 and latch 176 to their fully up positions is more than zero but not greater than 500-1000 psi.

When pressure on the lower surface of sleeve piston 156 urges actuation sleeve 138 up, the upper surface of sleeve piston 138 will displace fluid in actuation sleeve cylinder 154, thereby causing the displaced fluid to travel through inner passage 192 into inner cylinder 128, thereby urging inner piston 134 upward. Similarly, pressure on the lower surface of latch piston 178 urges latch 176 up and the upper surface of latch piston 178 displaces fluid in latch cylinder 164, thereby causing the displaced fluid to travel through inner passage 192 into inner cylinder 128, thereby urging inner piston 134 upward.

The full stroke of outer piston 160 to function actuation sleeve 138 and latch 176 through their full strokes is less than the stroke of inner piston 134. In embodiments, the full stroke of outer piston 160 to function actuation sleeve 138 and latch 176 through their full strokes is about 8.28", while the stroke of inner piston 134 is about 9.31". The available stroke of each of the outer piston 160 and inner piston 134 is greater than the full stroke required to actuate actuation sleeve 138 and latch 176. In embodiments, the available stroke of the outer piston can be about 9.25" and the available stroke of the inner piston can be about 10.25".

Shear pin 198 is inserted through actuation sleeve cap 144 to prevent axial movement of actuation sleeve 138 relative to body 104. Set screw 200 can be inserted through a threaded opening in outer body 114, perpendicular to shear pin 198, to secure the portion of shear pin 198 that remains in outer body 114 after shear pin 198 has sheared.

Referring now to FIG. 4, plug tool 224 can seal off in seal sub 196 at the lower end of body 104. Handling sub 226 is now connected to the running tool 100 drill stem connector 108, with a line attached to fluid connection point 234. A lower portion of handling sub 226 can contact the upper portion of plug tool 224 to hold plug tool 224 in position.

Shear pin 216 is inserted through tubing hanger actuation sleeve 212 into tubing hanger body 208 to keep tubing hanger actuation sleeve 212 in the fully up, or run-in, position. As one of skill in the art will appreciate, a detent mechanism or other device can be used to maintain tubing hanger actuation sleeve 212 in the fully up position.

Running tool 100 is picked up by, for example, hoist 20 connected to handling sub 226 and landed on tubing hanger 102. As running tool 100 lands on tubing hanger 102, latching elements 170 engage engagement ring 218. Tubing hanger viewport 220 and landing view hole 142 will be aligned to facilitate a visual inspection of the connection between running tool 100 and tubing hanger 102, and, specifically, the engagement of latching elements 170 with engagement ring 218. As one of skill in the art will appreciate, dimensional verification can also be used to verify proper landing and connection between running tool 100 and tubing hanger 102.

Referring to FIG. 2, with shear pin 198 installed, and running tool 100 set on top of tubing hanger 102, the hose connected to sleeve fluid passage 186 can be removed. Low pressure, such as, for example, about 500-1000 psi, is applied via the handling sub 226 to central bore 112. The fluid pressure is transferred through bore fluid passage 180 to inner cylinder 128, above inner piston 134. The fluid pressure urges inner piston 134 downward, thus increasing fluid pressure in inner passage 192 below inner piston 134. Because actuation sleeve 138 is fixed in place by shear pin 198, actuation sleeve does not move in response to the pressure of inner passage 192 urging actuation sleeve piston 156 downward. The low pressure is presented above inner piston 134 in inner cylinder 128 is too low to cause shear pin 198 to shear. Latch 176, however, is not restricted by a shear pin at this stage, so latch 176 is moved downward in response to fluid pressure in inner passage 192 causing an increase in fluid pressure in latch cylinder 164, above latch piston 178. Latch 176, thus, moves downward to a position wherein latch 176 is concentrically located with latching elements 170, preventing latching elements 170 from moving outward and thus disengaging engagement ring 218.

Shear pin 202 is now inserted through the sidewall of actuation sleeve 138 to engage groove 204, thus restricting axial movement of latch 176 relative to actuation sleeve 138. Shear pin 202 is a low capacity shear screw and thus is sheared in response to a lower shear force than the force required to cause shear pin 198 to shear. Latch 176 is pressure balanced when it is run and, thus, the pressure does not urge latch 176 out of the latched position. Low capacity shear pin 202 is a mechanism to ensure that latch 176 does not move and allow latching elements 170 to become unlatched. After landing and locking running tool 100 to tubing hanger 102, handling sub 226 and plug tool 224 are removed from running tool 100.

Referring now to FIGS. 1 and 5, running string 110 is connected to connector 108. Running string 110, which can be standard drill string or other types of tubular members, is used to run running tool 100, with tubing hanger 102 attached, through a tubular member such as a riser 12 until tubing hanger 102 lands in a well member such as casing hanger 240, in wellhead housing 14. Seal 242 is an annular seal assembly that is positioned between wellhead housing 14 and casing hanger 240 to form a seal therebetween. Seal 244 is an annular seal on an outer diameter of tubing hanger body 208 for forming a seal between tubing hanger 102 and casing hanger 240. The weight of running tool 100, tubing hanger 102, and any tubing 206 attached to tubing hanger 102 is normally sufficient to fully land tubing hanger 102 in wellhead housing 14 and set tubing hanger seal 244. Running string 110 can urge tubing hanger 102 downward into a set position.

In the event that the weight of the assembly and downward force from running string 110 is insufficient to set tubing hanger 102, riser 12 above running tool 100 can be sealed around running string 110 by, for example, closing the rams of BOP 18. Fluid pressure can then be introduced into the riser and used to set tubing hanger 102. As one of skill in the art will appreciate, such fluid pressure can be established by using "choke and kill" pressure. Because the fluid pressure in the riser is external to the body of running tool 100, it is referred to as external fluid pressure. The fluid pressure required to set tubing hanger 102 is typically about 250 psi, or less, and thus is below the pressure level that would cause shear pings 198 or 202 to shear.

When external fluid pressure is applied to set tubing hanger 102, drill pipe pressure, which is fluid pressure exerted through running string 110, can be applied to maintain balance within running tool 100. Drill pipe pressure that is only slightly higher than external fluid pressure is sufficient to exert downward force on inner piston 134, which in turn creates pressure below inner piston 134. That pressure is communicated through inner passage 192 to latch cylinder 164 and urges latch 176 downward so that it stays in the latched position.

Once tubing hanger 102 is landed and set, external pressure, if any, is vented via the choke and kill lines of BOP 18. Drill pipe pressure is then applied through running string 110. As previously described, drill pipe pressure passes through bore fluid passage 180 into inner cylinder 128, above inner piston 134 to urge inner piston 134 downward. The fluid from running string 110 stays above inner piston 134 and at no time does the fluid from running string 110 enter the closed-loop hydraulic system.

The downward movement of inner piston 134 creates pressure in inner cylinder 128 below inner piston 134. That pressure is communicated through inner passage 192 into latch cylinder 164, above latch piston 178, and into actuation sleeve cylinder 154, above sleeve piston 156. That pressure urges latch 176 downward to maintain latch 176 in the latched position. That pressure also urges actuation sleeve 138 downward. Actuation sleeve 138 is held in position by shear pin 198 and shear pin 202. Drill pipe pressure is increased until shear pins 198 and 202 each shear and actuation sleeve 138 moves downward.

When actuation sleeve 138 moves downward, it contacts the upper surface of tubing hanger actuation sleeve and urges tubing hanger actuation sleeve 212 downward. Low capacity shear pin 216 is sheared and tubing hanger actuation sleeve 212 moves downward to urge tubing hanger locking element 210 outward into engagement with wellhead housing 14.

With tubing hanger 102 locked in place, a standard overpull, or upward pull on running string 110, can confirm that tubing hanger 102 is properly locked. As one of skill in the art will appreciate, when tubing hanger locking elements 210 are properly locked into wellhead housing 14, tubing hanger 102 will resist at least a predetermined amount of pull on running string 110.

After confirming that tubing hanger 102 is locked into place, running tool 100 is ready to be recovered. To recover running tool 100, the drill pipe pressure is vented. Such venting releases downward force on inner piston 134, which in turn releases pressure on the closed-loop system in communication with inner passage 192. External pressure can now be increased by, for example, closing the rams of BOP 18 and increasing pressure in the riser bore below the rams. The pressure can be from, for example, choke and kill pressure. That external pressure is communicated through sleeve fluid passage 186 into outer cylinder 158, above outer piston 160. The external fluid remains above outer piston 160 and at no time does the external fluid enter the closed-loop hydraulic system. Therefore, the only fluid to contact sleeve piston 156 and latch piston 178 is clean hydraulic fluid that is entirely contained within running tool 100. Furthermore, because drill pipe pressure and external pressure are used to actuation inner piston 134 and outer piston 160, respectively, there is an absence of hydraulic lines connected to running tool 100. Thus, no umbilical lines are required to operate running tool 100. Furthermore, no hydraulic valves or distribution devices, such as darts, are used to operate running tool 100 when running tool 100 is in the riser.

The external pressure, thus, urges outer piston 160 downward. That downward movement increases the pressure in outer cylinder 158 below outer piston 160, thus increasing the pressure in the closed-loop hydraulic system in communication with outer passage 190. That pressure is communicated through outer passage 190 to actuation sleeve cylinder 154, below sleeve piston 156, thus urging actuation sleeve 138 upward. At the same time, that pressure is communicated through outer passage 190 to latch cylinder 164, below latch piston 178, thus urging latch 176 upward. By operating running tool 100 with drill pipe pressure and external pressure, running tool 100 does not need to rotate to set tubing hanger 102 or disengage from tubing hanger 102.

Figure 6:
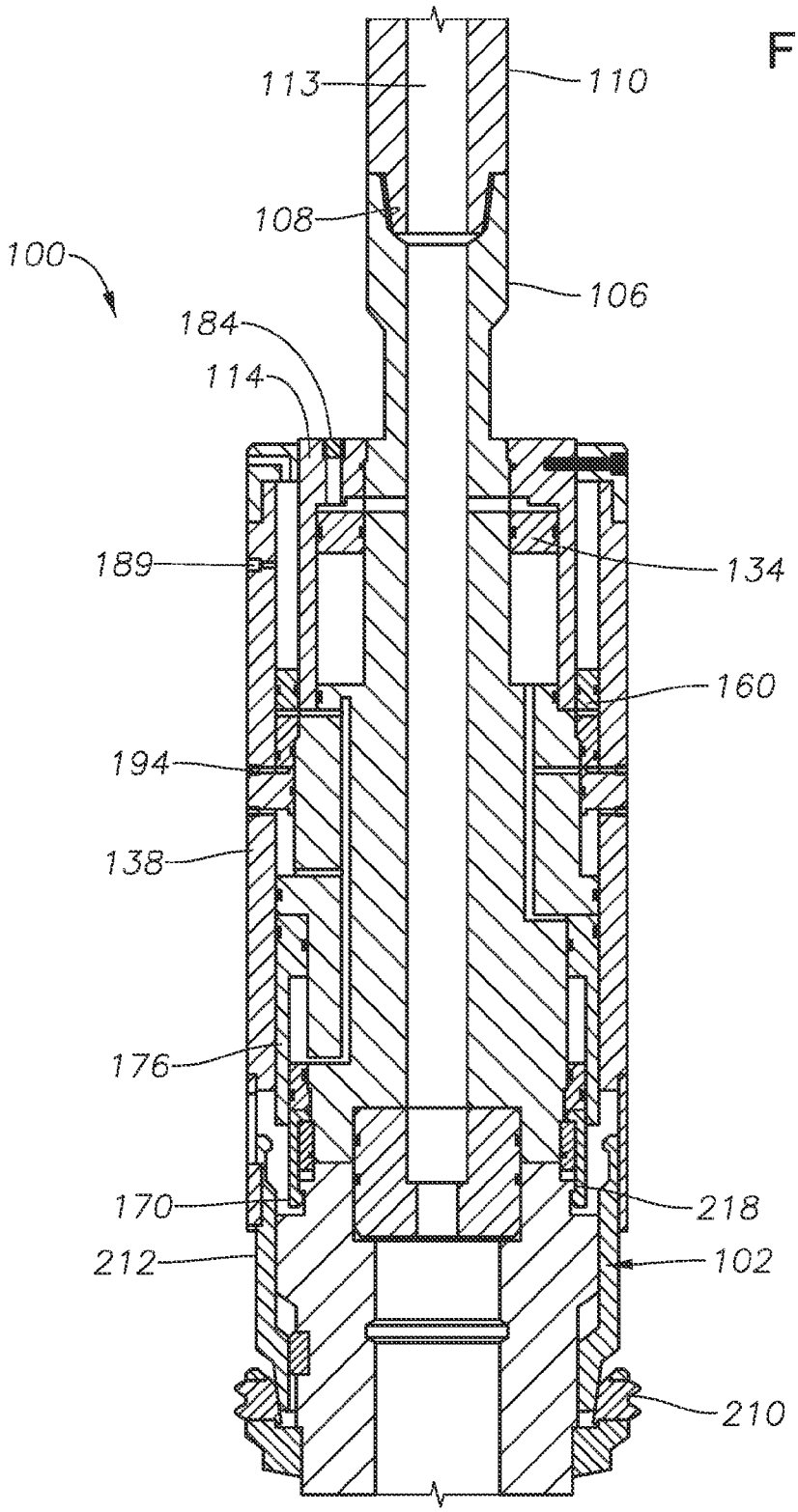
FIG. 6 is a sectional side view of the umbilical-less running tool of FIG. 2 and tubing hanger of FIG. 3, showing the release of the tubing hanger from the running tool.

Referring to FIG. 6, actuation sleeve 138 moves upward, while leaving tubing hanger actuation sleeve 212 in its downward position, holding tubing hanger locking elements 210 in their outward, or latched, position. Latch 176 moves upward and, thus, no longer holds latching elements 170 in engagement with engagement ring 218. Upward force on running string 110 is now applied to lift running tool 100 off of tubing hanger 102. Latching elements 170 disengage engagement ring 218 as running tool 100 is moved upward.

With running tool 100 back on the drilling platform, plugs 184 can be removed from the outer body 114 and the area above inner piston 134 can be flushed after use without disassembling running tool 100. The area above the outer piston 160 can be flushed after use, via ports 186, without disassembling running tool 100. No disassembly or "strip down" of running tool 100 is required after each run. For periodic maintenance, plugs 189 and 194 can be removed so that the portions of inner cylinder areas can be flushed as required.

While the invention has been shown or described in only some of its forms, it should be apparent to those skilled in the art that it is not so limited, but is susceptible to various changes without departing from the scope of the invention.

What is claimed is:

1. A method for setting an inner wellhead member in a bore of a subsea wellhead housing having an axis, the inner wellhead member having a radially expansible locking element and an axially movable member for engaging a profile in the wellhead housing, the method comprising:

providing a running tool with an axially movable latch sleeve having a latch sleeve piston and an axially movable actuation sleeve having an actuation sleeve piston;

releasably connecting the inner wellhead member to the running tool by moving the latch sleeve into engagement with the inner wellhead member;

running the running tool and the inner wellhead member on a running string through a riser assembly to the wellhead housing, the running string having a first flow passage, the riser assembly defining a second flow passage in an annulus surrounding the running string; then expanding the locking element into engagement with the profile by increasing fluid pressure in one of the first and second flow passages, which applies fluid pressure to the actuation sleeve piston to move the actuation sleeve and the axially movable member axially relative to the locking element; then releasing the latch sleeve of the running tool from the inner wellhead member by increasing fluid pressure in the other of the first and second flow passages, which applies fluid pressure to the latch sleeve piston to move the latch sleeve from engagement with the inner wellhead member; and withdrawing the running tool on the running string.

2. The method according to claim 1, wherein:

the running tool further comprises a setting piston and a release piston, the setting piston separating fluid in the first flow passage from a liquid in a setting chamber between the setting piston and the actuation sleeve piston, the release piston separating fluid in the second flow passage from a liquid in a release chamber between the release piston and the latch sleeve piston;

applying fluid pressure to the actuation sleeve piston comprises applying fluid pressure to the setting piston, which in turn transmits the fluid pressure through the liquid in the setting chamber to the actuation sleeve piston; and applying fluid pressure to the latch sleeve piston comprises applying fluid pressure to the release piston, which in turn transmits the fluid pressure through the liquid in the release chamber to the latch sleeve piston.

3. The method according to claim 2, wherein:

the setting chamber also extends between the setting piston the latch sleeve piston; and applying fluid pressure to the setting piston also applies fluid pressure through the liquid in the setting chamber to the latch sleeve piston in a direction that urges the latch sleeve to remain engaged with the inner wellhead member.

4. The method of claim 3, wherein:

the release chamber also extends between the release piston and the actuation sleeve piston; and applying fluid pressure to the release piston also applies fluid pressure through the liquid in the release chamber to the actuation sleeve piston in a direction that urges the actuation sleeve piston to move the actuation sleeve away from the axially movable member.

5. The method according to claim 4, wherein:

applying fluid pressure to the setting piston applies the fluid pressure to a first side of the actuation sleeve piston, and liquid in the setting chamber on the second side of the actuation sleeve piston expels to the release chamber; and applying fluid pressure to the release piston applies the fluid pressure to a first side of the latch sleeve piston, and liquid in the release chamber on the second side of the latch sleeve piston expels to the setting chamber.

6. The method according to claim 4, wherein applying fluid pressure to the setting piston results in the liquid in the setting chamber applying pressure to an upper side of the actuation sleeve piston and an upper side of the latch sleeve piston.

7. The method according to claim 4, wherein applying fluid pressure to the release piston results in the liquid in the release chamber applying pressure to a lower side of the actuation sleeve piston and a lower side of the latch sleeve piston.

8. A method for setting an inner wellhead member in a subsea wellhead housing, the method comprising:

(a) providing a running tool having a setting piston, a release piston, an actuation sleeve with an actuation sleeve piston, and a latch sleeve with a latch sleeve piston, the setting, release, actuation sleeve and latch sleeve pistons each being in communication with a closed-loop hydraulic system;

(b) providing the inner wellhead member with a locking element that moves between inner and outer positions, the locking element being in engagement with the actuation sleeve;

(c) latching the running tool to the inner wellhead member with a latching element of the running tool and moving the latch sleeve from a release position to a latched position;

(d) running the running tool and the inner wellhead member on a running string through a riser assembly until the inner wellhead member lands in the wellhead housing, an inner fluid passage being defined by the running string and the running tool and an outer fluid passage being defined by an annulus of the riser assembly and the running tool, the closed-loop hydraulic system containing a liquid that is isolated from the fluid passages by the setting piston and the release piston; then (e) locking the inner wellhead member to the wellhead housing by applying fluid pressure through one of the fluid passages to the setting piston, which increases a fluid pressure in the liquid in the closed loop hydraulic system between the setting piston and the actuation sleeve piston and moves the actuation sleeve to cause the locking element to move to the outer position; and then (f) applying fluid pressure through the other of the fluid passages to the release piston, which increases a fluid pressure in the liquid in the closed loop hydraulic system between the release piston and the latch sleeve piston and moves the latch sleeve out of engagement with the latching element so that the latching element can unlatch from the inner wellhead member.

9. The method of claim 8, wherein each of the setting piston and the release piston are separated from the actuation sleeve piston and the latch sleeve piston by portions of the closed-loop hydraulic system.

10. The method of claim 8, wherein each of the setting piston and the release piston are in communication with a single reservoir of liquid in the closed-loop hydraulic system so that movement of the setting piston to move the actuation sleeve piston causes movement of the release piston in a direction away from the latch sleeve piston.

11. The method of claim 8, wherein step (e) is performed by applying fluid pressure through the inner fluid passage.

12. The method of claim 8, wherein step (f) comprises applying fluid pressure through the outer fluid passage.

13. The method of claim 8, wherein:

applying fluid pressure through one of the fluid passages to the setting piston causes fluid pressure in the closed-loop hydraulic system to be applied to an upper side of the actuation sleeve piston and an upper side of the latch sleeve piston; and applying fluid pressure through the other of the fluid passages to the release piston causes fluid pressure in the closed-loop hydraulic system to be applied to a lower side of the latch sleeve piston and a lower side of the actuation sleeve piston.

14. A running tool for setting an inner wellhead member in a subsea wellhead housing, the running tool comprising:

a setting pistol, a release piston, an actuation sleeve piston, and a latch sleeve piston, each piston comprising a first end and a second end;

a closed-loop hydraulic system having a setting portion located between the second end of the setting piston and the first end of the actuating piston, the closed-loop hydraulic system having a release portion located between the second end of the release piston and the first end of the latch sleeve piston;

an actuation sleeve joined to the actuation sleeve piston for movement therewith, the actuation sleeve moving from an unlocked position to a locked position in response to movement of the setting piston in a direction that increases fluid pressure in the setting portion of the closed-loop hydraulic system, the actuation sleeve urging a locking member of the inner wellhead member into engagement with the subsea wellhead housing when moving from the unlocked position to the locked position;

a latch sleeve joined to the latch sleeve piston for movement therewith, the latch sleeve moving from latched position to unlatched position in response to movement of one of the release piston in a direction that increases fluid pressure in the release portion of the closed-loop hydraulic system, the unlatched position releasing the running tool from the inner wellhead member;

a running tool body having an inner flow passage for receiving fluid pumped down a running string;

an inner flow passage port extending from the inner flow passage for delivering fluid from the inner flow passage to the first end of one of the setting and release pistons; and an external flow passage port in the running tool for delivering fluid from an outer flow passage surrounding the running tool to the first end of the other of the setting and release pistons.

15. The running tool according to claim 14, wherein:

the setting portion of the closed-loop hydraulic system also extends to a second end of the latch sleeve piston; and the release portion of the closed-loop hydraulic system also extends to a second end of the actuation sleeve piston.

16. The running tool according to claim 15, wherein:

one of the setting and release pistons prevents fluid within the inner flow passage from entering the closed-loop hydraulic system; and the other of the setting and release pistons prevents fluid within the outer flow passage from entering the closed-loop hydraulic system.

17. The running tool according to claim 14, wherein a volume of fluid in the closed-loop hydraulic system does not change in response to movement of the pistons.

18. The running tool according to claim 14, wherein movement of one of the setting and release pistons urges the other one of the setting and release pistons to move.

19. The running tool according to claim 14, wherein:

the second ends of the setting, release, actuation, and latch sleeve pistons are on a lower side of each of the setting, release, actuation and latch sleeve pistons.

20. The running tool according to claim 14, wherein the latch sleeve moves to the latched position in response to the application of fluid pressure to the first side of the setting piston.

* * * * *